US007581914B2

(12) United States Patent
Lyman, Jr.

(10) Patent No.: US 7,581,914 B2
(45) Date of Patent: Sep. 1, 2009

(54) FOLDABLE PAPER PADDING PRESS

(76) Inventor: Hugh Marion Lyman, Jr., 27639 SE. 401st St., Enumclaw, WA (US) 98022

( * ) Notice: Subject to any disclaimer, the term of this patent is extended or adjusted under 35 U.S.C. 154(b) by 677 days.

(21) Appl. No.: 11/368,310

(22) Filed: Mar. 6, 2006

(65) Prior Publication Data

US 2007/0158523 A1 Jul. 12, 2007

Related U.S. Application Data

(60) Provisional application No. 60/758,086, filed on Jan. 12, 2006.

(51) Int. Cl.
*B42C 13/00* (2006.01)

(52) U.S. Cl. ..... 412/10; 100/219

(58) Field of Classification Search ..... 412/10, 412/33, 37, 6, 8, 1; 100/219, 291
See application file for complete search history.

(56) References Cited

U.S. PATENT DOCUMENTS

| | | | | | |
|---|---|---|---|---|---|
| 354,953 | A | | 12/1886 | Tracey | |
| 452,898 | A | | 5/1891 | Jones | |
| 796,346 | A | * | 8/1905 | McBee | 408/97 |
| 943,094 | A | | 12/1909 | McBee | |
| 1,024,721 | A | | 4/1912 | Davis | |
| 1,285,914 | A | | 11/1918 | Bone | |
| 1,354,061 | A | | 9/1920 | Palmer | |
| 1,928,789 | A | | 10/1933 | Legge | |
| 2,030,353 | A | | 2/1936 | Cole | |
| 2,169,341 | A | | 8/1939 | Goines et al. | |
| 2,494,424 | A | | 1/1950 | Adelsohn et al. | |
| 2,499,744 | A | | 3/1950 | Goines et al. | |
| 2,503,112 | A | | 4/1950 | Holtz | |
| 2,526,987 | A | * | 10/1950 | Wilson | 100/219 |
| 2,641,781 | A | | 6/1953 | Haskell | |
| 2,654,932 | A | | 10/1953 | Goudie | |
| 2,708,400 | A | | 5/1955 | Tait | |
| 3,261,044 | A | * | 7/1966 | Hoff | 412/9 |
| 3,986,447 | A | | 10/1976 | Zimmer | |
| 4,146,942 | A | | 4/1979 | Westra et al. | |
| 4,147,102 | A | * | 4/1979 | Bigelow | 100/257 |
| 4,373,843 | A | | 2/1983 | Lang | |
| 4,488,845 | A | | 12/1984 | Dupre | |
| D400,914 | S | * | 11/1998 | Corcoran et al. | D18/34.1 |
| 7,393,171 | B2 | * | 7/2008 | Fu | 412/5 |

OTHER PUBLICATIONS

Commercially available Padding Presses from online publications. Attached Exhibit A.
Foldable Paper Padding Press flyer of present invention. Exhibit B.
Museum padding press made in 1878. Attached Exhitbit C.

* cited by examiner

*Primary Examiner*—Dana Ross
*Assistant Examiner*—Jamila Williams

(57) ABSTRACT

A foldable paper padding press for compressing paper and other sheet material, wherein adhesive is applied to the compressed edges of paper for making pads, tablets and books. The components of the press rotate around a base for easy loading, padding and storing.

3 Claims, 6 Drawing Sheets

FOLDABLE PAPER PADDING PRESS

RELATED APPLICATIONS

This patent application is a continuation-in-part application of co-pending U.S. patent application Ser. No. 60/758,086, filed Jan. 12, 2006, for Foldable Paper Padding Press, by Hugh M. Lyman, Jr., included by reference herein and for which benefit of the priority date is hereby claimed.

FIELD OF THE INVENTION

This invention relates to padding presses, and more particularly to a simple desk top device for padding varying sizes of paper and other sheet material into pads.

BACKGROUND OF THE INVENTION

Paper padding is a known and frequently used process for making booklets, memo, note and scratch pads. Prior art for padding presses have been known for some time. Plain or printed paper of normally equal dimensions is placed and aligned in the press, clamped tight and then the compressed edges receive a common adhesive padding compound.

Prior art presents varying methods and systems common to the process. Exemplary of the padding presses of prior art are shown in U.S. Pat. Nos. 354,953; 452,898; 796,346; 943,094; 1,024,721; 1,285,914; 1,354,061; 1,928,789; 2,030,353; 2,169,341; 2,494,424; 2,499,744; 2,503,112; 2,641,781; 2,654,932; 2,708,400; 3,986,447; 4,146,942; 4,373,843; and 4,488,845. These all present many complicated mechanisms requiring awkward manipulations for accomplishing the padding process. U.S. Pat. No. 4,488,845 issued to Dupre is a typical example, with complicated clamping mechanisms. It illustrates a major problem with most padding presses, wherein the compressed paper edges are at an awkward angle for applying liquid adhesive with a brush as Dupre requires a drip trough for receiving run-off adhesive. U.S. Pat. No. 1,354,061 issued to Palmer is one of a few that offers means for positioning the paper in a convenient position for applying the adhesive, yet his invention is complicated requiring considerable space.

Heretofore, prior art fails to address a desk top paper padding press device for the home and small office that is simple to use, folds to store in a small space, is easy to tilt for positioning a paper stack to a convenient position for applying adhesive and is inexpensive to produce.

It is therefore an object of the invention to provide a simple paper padding press for aligning a stack of paper to be padded.

It is another object of the invention to provide a paper padding press that easily compresses a paper stack after its alignment.

It is another object of the invention to provide a paper padding press that the alignment back plate is quickly and easily rotated away from the edge of the paper stack.

It is another object of the invention to provide a paper padding press that can position the paper stack so the edge receiving the adhesive compound is in a horizontal position.

It is another object of the invention to provide a paper padding press that can be stored in a minimum of space.

It is another object of the invention to provide a paper padding press that can be used on a table, desk or work top.

It is another object of the invention to provide a paper padding press that is packaged for shipment and stored in a small container.

It is another object of the invention to provide a paper padding press that does not require assembly before use or disassembly after use.

It is another object of the invention to provide a paper padding press that is simple and inexpensive to produce.

It is another object of the invention to provide a paper padding press that is light in weight for easy portability.

SUMMARY OF THE INVENTION

In accordance with the present invention, there is provided a foldable paper padding press for making paper pads from sheet material, which is simple, compact, inexpensive and easy to operate. The invention includes a base plate assembly, a back plate assembly and a clamp arm assembly. The base plate assembly comprises a flat panel with two leg members attached vertically to the underside of the flat panel. The back plate assembly comprises a flat panel with two cradle shaped supports rigidly attached to the back plate, wherein the back plate assembly is rotatably attached to the base plate assembly. The clamping arm assembly comprises two clamp arms rigidly connected with a cross bar handle and rotatably attached to the base plate assembly. Further provided is a pressure plate, a pressure bar and two wedges to provide one means for compressing a paper stack. The base plate assembly, back plate assembly and clamp arm assembly are rotatable through matching holes with a single axle shaft. The operation consists of placing the paper stack on the base plate assembly; aligning the paper to the back plate assembly; and positioning the clamping assembly. The pressure plate and pressure bar are positioned on top of the paper stack and the pressure wedges are inserted into slots of the clamp arms and tapped inward, forcing the pressure plate down against the paper stack compressing the stack. Once the paper stack is compressed the entire assembly is tilted 90° to position the paper stack edges horizontally for applying padding compound adhesive. The back plate assembly is rotated away from paper stack edges that receive the adhesive. Adhesive compound is applied in this convenient position. After the adhesive is cured and the padded paper removed, the device is folded into a compact size for easy storage.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures. For purpose of brevity the 'foldable paper padding press' will be referred to as 'device'.

Figure 1:
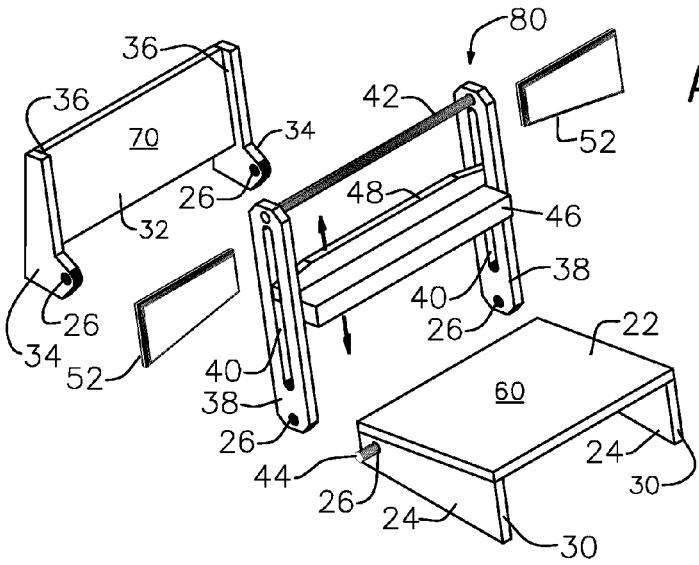
FIG. 1 is a isometric expanded front view of the foldable padding press invention.

The following reference numerals are used to indicate the parts and environment of the invention:

| | |
|---|---|
| 20 | device |
| 22 | base bed plate |
| 24 | base leg plate |
| 26 | shaft hole |
| 28 | rib |
| 30 | base leg front edge |
| 32 | back plate |
| 34 | cradle support |
| 35 | notch |
| 36 | alignment lip |
| 38 | clamp arm |
| 39 | rod clamp arm |
| 40 | clamp arm slot |
| 41 | flange lug |
| 42 | handle cross bar |
| 44 | axle shaft |
| 45 | axle pin |
| 46 | pressure plate |
| 48 | pressure bar |
| 49 | alternate pressure bar |
| 50 | pressure bar taper |
| 52 | pressure wedge |
| 53 | screw clamp |
| 54 | paper stack |
| 55 | grip clamp |
| 56 | paint brush |
| 58 | spacer plate |
| 60 | base plate assembly |
| 70 | back plate assembly |
| 80 | clamp arm assembly |
| 90 | rod clamp arm assembly |

DESCRIPTION OF THE PREFERRED EMBODIMENT

The following description, taken in conjunction with the drawings, set forth the preferred embodiment of the present invention in such a manner that anyone with ordinary skill can make and use the invention. The embodiment of the invention disclosed herein is the best method envisioned by the inventor for use in a home and office environment, although it should be understood that various modifications can be accomplished within the scope of the present invention.

Referring now to the drawings, and in particular to FIG. 1, the foldable paper padding press (device 20) is for padding paper 54 and other sheet material, comprising three assemblies: a base plate assembly 60 which provides a stationary platform, a back plate assembly 70 which provides for paper alignment, a clamping arm assembly 80 for compressing paper 54. Other components include a pressure plate 46, a pressure bar 48, two wedges 52 and spacer plates, which operate in conjunction with the clamp arm assembly 80.

The base plate assembly 60 comprises a base bed plate 22 with two base leg plates 24 rigidly attached orthogonally to the bottom of the base bed plate 22. The base leg plates 24 are of a polygon shape so the base bed plate 22 is resting on table or desk top at an inclined angle to horizontal. The base leg plates 24 may also be rectangular whereby the base bed plate 22 will rest parallel to the table or desk top. Each base leg plate 24 has a shaft hole 26 disposed therein, wherein an axle shaft 44 freely rotates.

Figure 2:
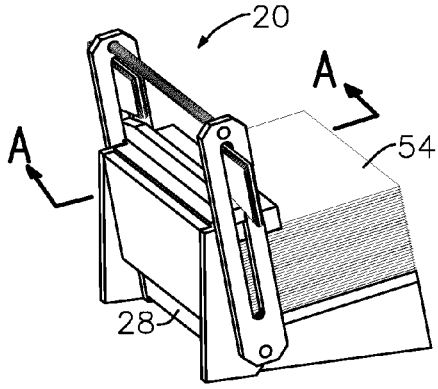
FIG. 2 is a trimetric back view of the assembled foldable padding press invention.

The back plate assembly 70 is the means for aligning the paper stack 54 and other sheet material (FIG. 2). The back plate assembly 70 comprises a back plate 32 with two cradle supports 34, rigidly attached to the back plate 32, constructed so that the cradle supports 34 fit outside of the base bed plate 22. The cradle supports 34 protrude beyond the face of the back plate 32 forming an alignment lip 36. Each cradle support 34 has a shaft hole 26 disposed therein, wherein the back plate assembly 70 is rotatably attached to the base plate assembly by a single axle shaft 44.

Figure 5:
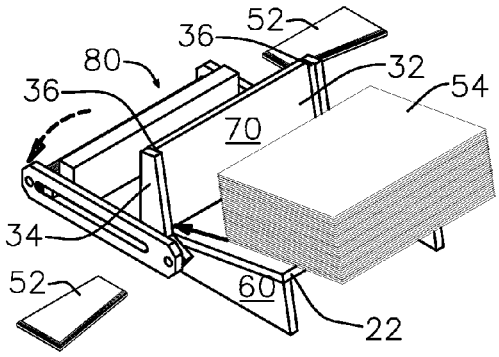
FIG. 5 is a isometric process view of the foldable padding press invention illustrating paper being placed on the device.

As illustrated the base leg plates 24 and the cradle supports 34 are all rigidly attached to their respective panels by any appropriate method. The cradle supports 34 hold the back plate assembly 70 perpendicular to the base plate assembly 60 when it is positioned for loading paper or other sheet material as shown in FIG. 5. The back plate assembly 70 rotates forward and backward from the loading position.

The clamp arm assembly 80 comprises two clamp arms 38 and a cross bar handle 42. The cross bar handle 42 is rigidly connected to the two clamp arms 38. Each clamp arm 38 has a longitudinal slot 40 disposed therein. The clamp arms 38 are rigidly attached to a single axle shaft 44 in the final assembly of the device 20. The axle shaft 44 extends through the shaft holes 26 of the back plate assembly 70 and the base plate assembly 60. The shaft holes 26 are disposed within each assembly 60 and 70 at a position that allows for perfect alignment of the respective assemblies and accommodates proper rotation thereof. A pressure plate 46 fits inside between the clamp arms 38. The pressure bar 48 can be rigidly attached to the pressure plate 46 or be separate. The pressure bar 48 projects beyond the ends of the pressure plate 46 to fit into the slots 40 of the clamp arms 38, thus is transversely positioned in the clamp arms 38. Further, the pressure bar 48 ends can be square or tapered at the top edge, as indicated by numeral 50. The pressure wedges 52 are polygon shaped thereby they provide pressure between the top of the clamp arm slots 40 and the pressure bar 48 when they are inserted in the clamp arm slots 40 and forced inward toward the center of the assembly. The clamp arm assembly rotates forward and backward around the base plate assembly.

The drawing figures refer to the panel components and attachment as if constructed of wood. Anyone ordinarily skilled in the art would know that other types of material such as metal or plastic could be used with appropriate attachments.

FIG. 2 illustrates the device 20 with the three assemblies 60, 70, 80 rotatably attached. Once assembled the single axle shaft 44 is rigidly attached to the clamp arms 38, wherein the single axle shaft 44 rotates in the respective shaft holes 26 of the base plate assembly 60 and the back plate assembly 70, allowing the back plate assembly 70 and the clamp arm assembly 80 to freely rotate around the base plate assembly 60. The clamp arm assembly 80 rotates 360° around the base plate assembly 60 and the back plate assembly rotates approximately 270° from forward to backward on the base plate assembly 60.

Figure 18:
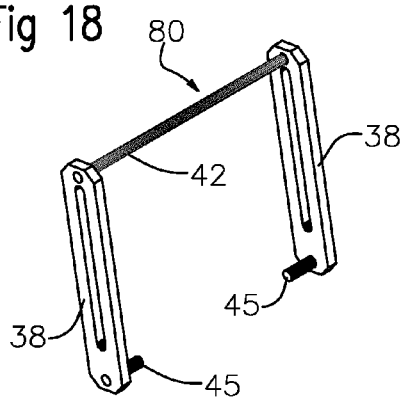
FIG. 18 is a isometric view of the clamp arm assembly with axle pins.

An alternate method of rotatably attaching the clamping assembly 80 to the base plate assembly 60 is by individual axle pins 45 rigidly attached to each clamp arm 38 as illustrated in FIG. 18.

Figure 3:
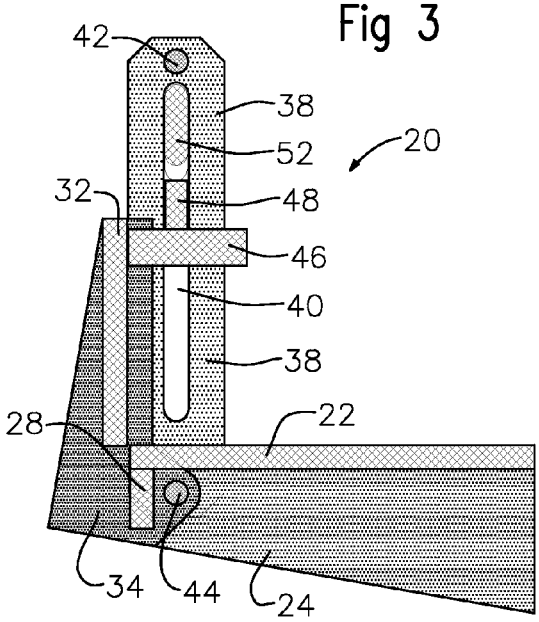
FIG. 3 is a side sectional view of the foldable padding press invention taken along lines A-A of FIG. 2.

FIG. 3 is a side section view of the inventive embodiment taken along lines A-A as shown in FIG. 2, excluding the paper stack 54. The view illustrates the position of a rib 28 rigidly attached to the bottom rear of the base bed plate 22. This rib 28 minimizes deflection of the base bed plate 22 when under compression. The pressure bar 48 freely traverses up or down in clamp arm slots 40.

Figure 4:
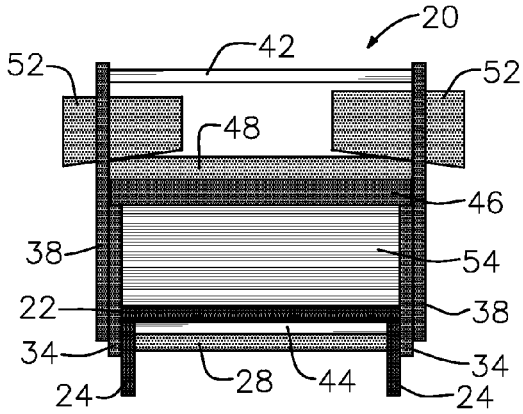
FIG. 4 is a front view of the foldable padding press invention.

FIG. 4 is a front view of the device 20 illustrating the assembled position of the base leg plates 24, the cradle supports 34, the clamp arms 38, the rib 28 and the single axle shaft 44.

Referring to FIG. 5, the device 20 is shown positioned for loading a paper stack 54. The clamp arm assembly 80 is rotated back to rest flat on the work top surface where it is out of the way while paper 54 is being stacked on the device 20. The back plate assembly 70 is positioned with the back plate 32 perpendicular to the base bed plate 22 and maintains that position by the cradle arms 34. The paper stack 54 is placed on the base bed plate 22 and is aligned between the alignment lips 36 of the back plate assembly 70.

Figure 6:
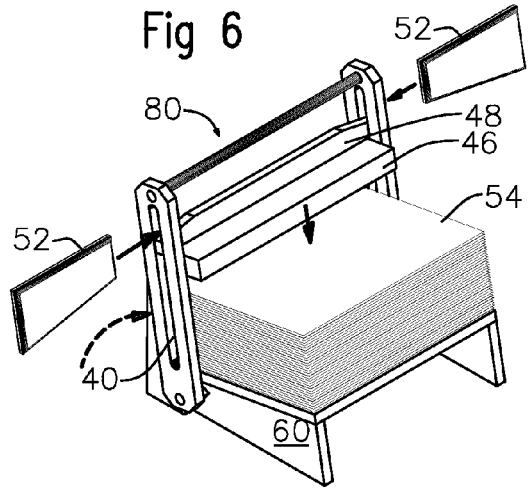
FIG. 6 is a isometric process view of the foldable padding press invention with the clamping assembly being positioned.

With paper 54 aligned, the clamp arm assembly 80 is rotated so that the pressure plate 46 is parallel to the paper stack 54 as shown in FIG. 6. The pressure plate 46 and the pressure bar 48 both slide down to rest on the paper stack 54. Pressure wedges 52 are inserted into the slots 40 engaging against the compression taper 50 of the pressure bar 48 and the top of the slots 40.

Figure 7:
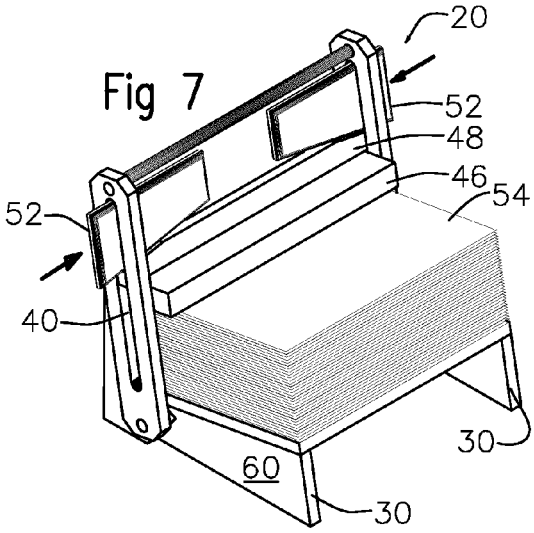
FIG. 7 is a isometric process view of the foldable padding press invention with a paper stack compressed.

FIG. 7 shows pressure wedges 52 fully inserted in the clamp arm slots 40, wherein the pressure wedges 52 exert pressure on the pressure bar 48 compressing the pressure plate 46 against the paper stack 54. The pressure wedges 52 can be tapped into the slots 40 with the palm of the hands.

Figure 8:
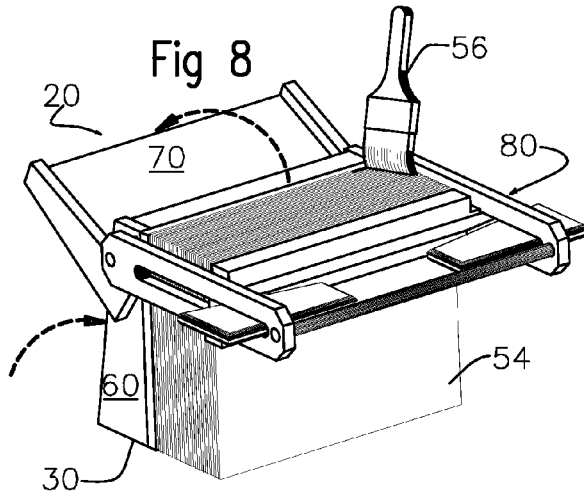
FIG. 8 is a trimetric process view of the inventive foldable padding press invention positioned for applying adhesive.

In FIG. 8 is shown the device 20 rotated to rest on the face edge of the base leg front edges 30. The back plate assembly 70 is rotated backward and away from the paper stack 54 exposing the compressed paper stack 54 edges. The edges of the horizontally positioned compressed paper stack 54 are ready to be coated with adhesive. This is the best position for applying adhesive compound to the compressed paper stack 54 edges, whereby preventing liquid adhesive from running or dripping. The brush 56 illustrates applying adhesive padding compound.

After the adhesive compound has cured the loaded device 20 is returned to the loading position and the pressure wedges 52 are released. This can be accomplished by wiggling the pressure wedges 52 loose. The padded paper 54 is removed and the device 20 is ready for another load of paper 54, or for storage.

Figure 9:
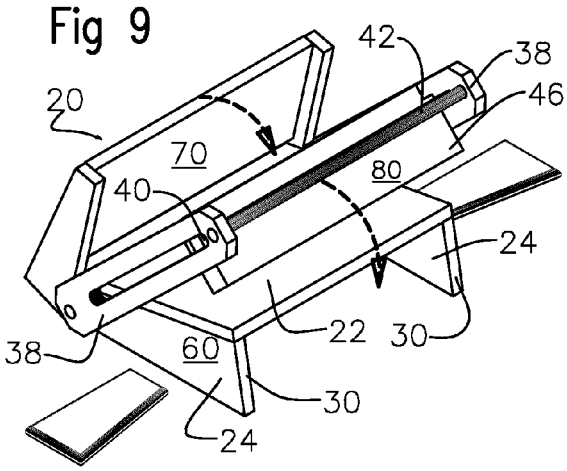
FIG. 9 is a isometric process view of the foldable padding press invention illustrating the start of the device being folded.

FIG. 9 illustrates the process for storing the device 20. The pressure plate 46 is held to the top of the slots 40 in the clamp arms 38 and is then rotated forward till the edge of the pressure plate 46 rests against the base leg front edges 30 of the base legs 24. Next the back plate assembly 70 is rotated forward and rests upon the base bed plate 22 of the base plate assembly 60.

Figure 10:
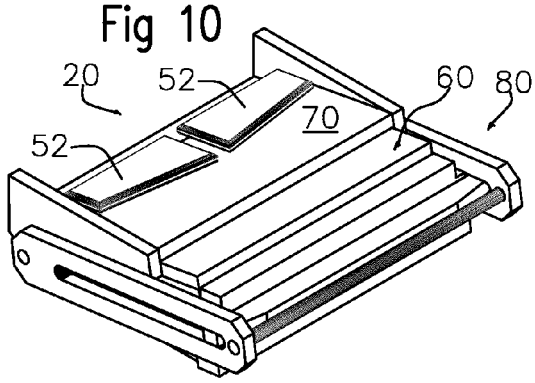
FIG. 10 is a isometric process view of the device fully folded ready for storing.

FIG. 10 illustrates the device 20 fully folded with the pressure wedges 52 placed in position for storage. Folding the device 20 reduces the space it occupies by approximately two thirds.

Figure 11:
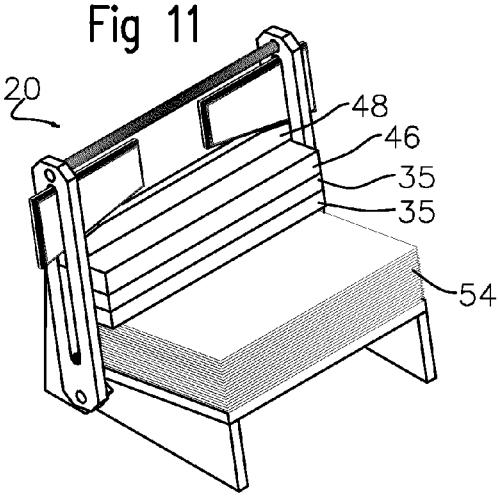
FIG. 11 is a isometric view of the invention with spacer plates included.

When varying heights of paper stacks 54 are to be compressed as shown in FIG. 11, one or more auxiliary spacer plates 58 are placed between the pressure plate 46 and the paper stack 54, thereby maintaining the correct spacing between the top of the clamp arms slots 40 and the top of the pressure bar 48 for the insertion of the pressure wedges 52.

Figure 12:
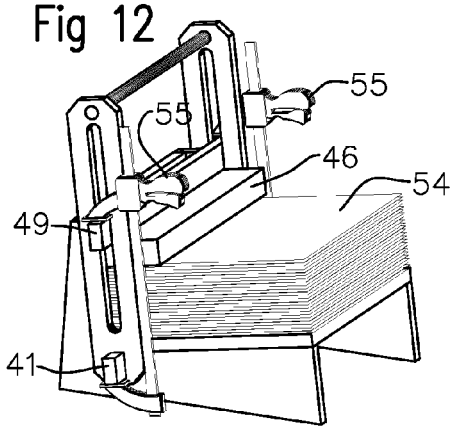
FIG. 12 is a trimetric view of the invention illustrating clamping with grip clamps to extended pressure bar and flange lug.

FIG. 12 illustrates an alternate method of compressing the paper stack 54. A flange lug 41 is added to the bottom of the clamp arms 38 and an alternate pressure bar 49 without the taper 50 protrudes beyond the clamp arms 38, wherein screw or grip clamps 55 can be engaged from the flange lug 41 to the pressure bar 49 and tightened thereon. Another method is to extend the axle shaft 44 beyond the clamp arms 38 in lieu of the flange lug 41.

Figure 13:
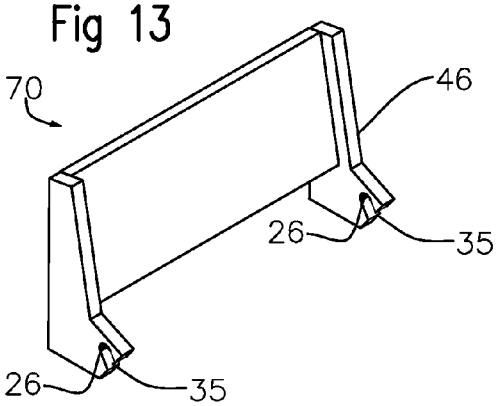
FIG. 13 is a isometric view of the back plate assembly illustrating notches in the cradle supports.
Figure 14:
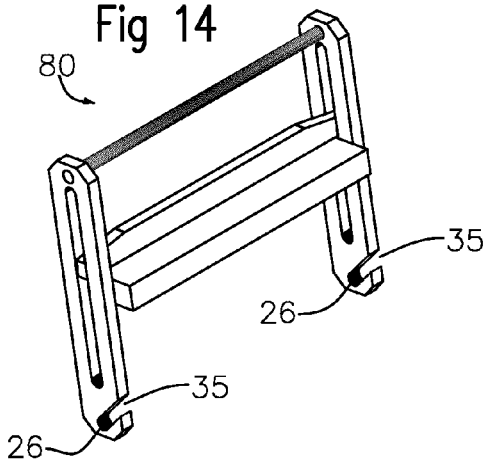
FIG. 14 is a isometric view of the clamp arm assembly with notches in the clamp arms.

If it is desirable to remove the back plate assembly 70 and the clamp arm assembly 80 from the base plate assembly 60 at the axle shaft 44, it can be accomplished by providing a notch 35 to the holes 26 in the cradle supports 34 and a notch 35 to the holes 26 of the clamp arms 38 of the respective assemblies 70 and 80 as shown in FIGS. 13 and 14. In this configuration the axle shaft 44 is rigidly connected to the back plate assembly 70 or the base plate assembly 60.

Figure 15:
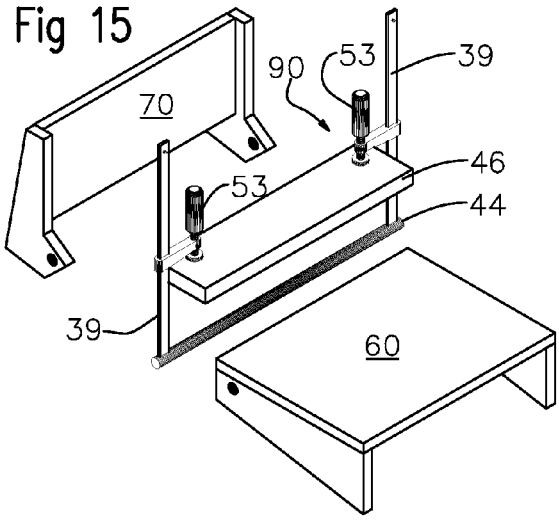
FIG. 15 is an exploded isometric view of the invention illustrating an alternate clamp arm assembly with screw type clamps.

It would be evident to anyone ordinarily skilled in the art that there are different means of compressing the paper stack 54 in the scope of the clamp arm assembly 80. FIG. 15 illustrates one such means with an alternate rod clamp arm assembly 90. This assembly 90 introduces a rod clamp arm 39 rigidly attached to the axle shaft 44, wherein transversely affixed to the rod clamp arms 39 are screw clamps 53 or grip clamps 55. Screw clamps 53 or grip clamps 55 are positioned onto the pressure plate 46 and hand tightened, compressing the paper stack 54 as shown in FIG. 16.

Figure 17:
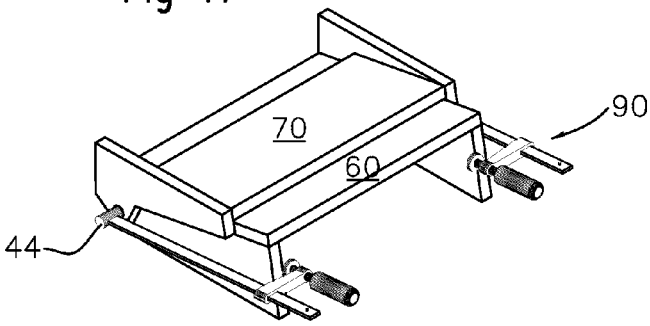
FIG. 17 is a isometric view of the invention folded with screw type clamps shown in FIGS. 15 and 16.

FIG. 17 shows the device 20 folded with the rod clamp arm assembly 90.

FIG. 18 illustrates an alternate means of rotatably connecting the clamp arm assembly 80 to the base plate assembly 60 using axle pins 45 rigidly attached to each clamp arm 38, in lieu of a single axle shaft 44.

Figure 16:
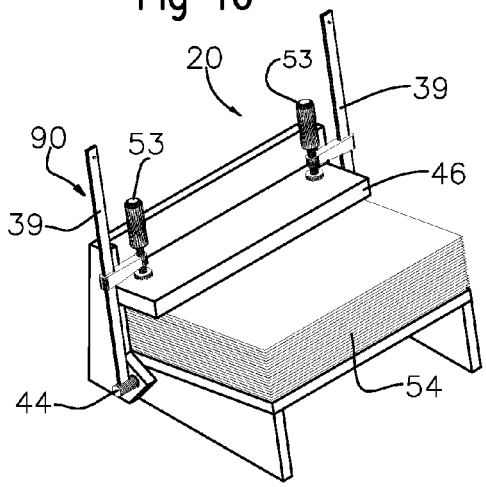
FIG. 16 is a isometric view of the invention, compressing a paper stack with screw type clamps shown in FIG. 15.
Figure 19:
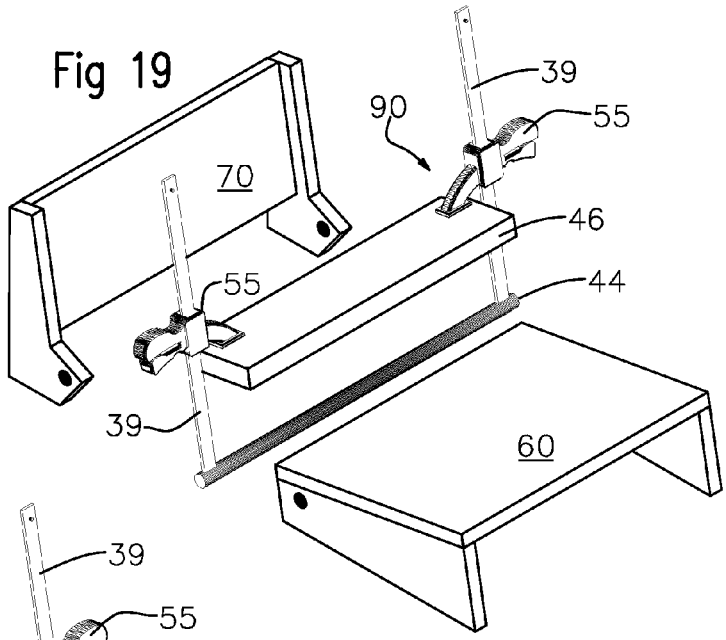
FIG. 19 is a isometric exploded view of the invention illustrating another alternate clamp arm assembly with grip type clamps.
Figure 20:
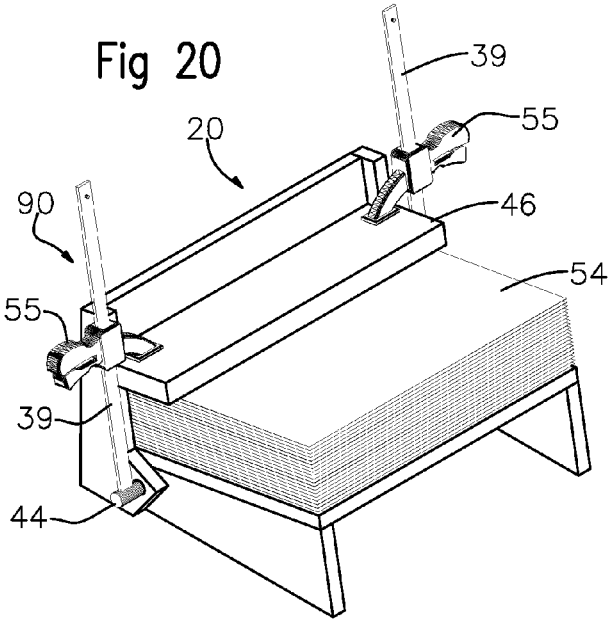
FIG. 20 is a isometric view of the invention, compressing a paper stack with grip type clamps shown in FIG. 19.
Figure 21:
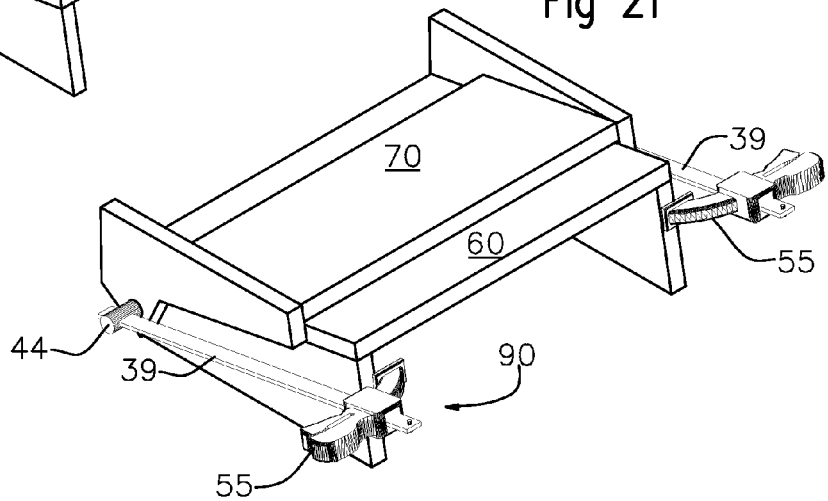
FIG. 21 is a isometric view of the invention folded with grip type clamps shown in FIGS. 19 and 20.

FIGS. 19, 20, 21 illustrations are similar to FIGS. 15, 16, 17 wherein the screw clamp 53 is replaced with grip clamps 55.

Figure 22:
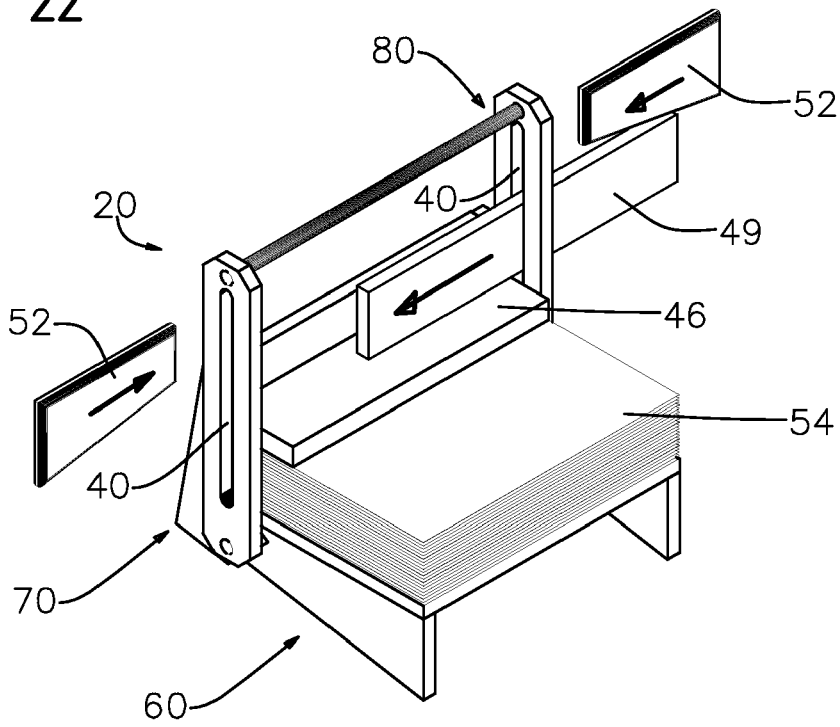
FIG. 22 is an isometric process view of the invention illustrating an alternate pressure bar clamping means.

FIG. 22 shows another alternate means for pressing the paper stack 54, wherein the alternate pressure bar 49 is used. The pressure plate 46 is placed on the top of the paper stack 54. The alternate pressure bar 49 is slipped into the clamp arm slots 40 from one side until each end of the alternate pressure bar 49 is engaged in each clamp arm slot 40 of the clamp arm assembly 80. The alternate pressure bar 49 can be of different widths and used single or in combination with a second pressure bar to accommodate various thicknesses of paper stacks 54, thereby eliminating the use of spacer plates 58.

Figure 23:
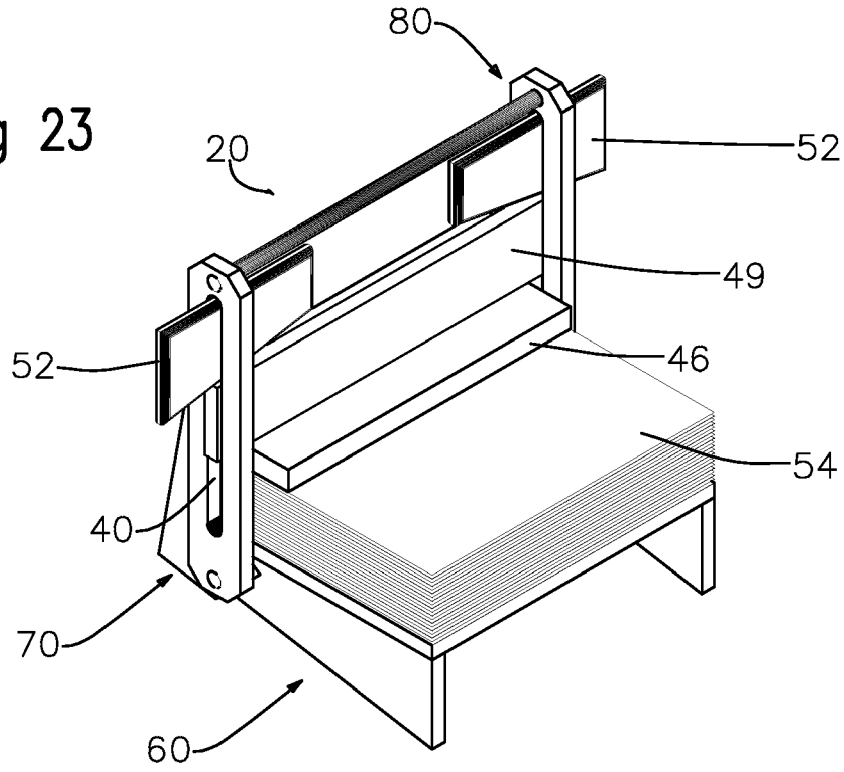
FIG. 23 is an isometric view of the alternate pressure bar clamping means wherein, the paper stack is compressed and ready for having the paper edges glued.

FIG. 23 shows the device 20 with the wedges 52 inserted sufficiently to press the paper stack 54, wherein the paper is ready to have the padding compound applied as shown in FIG. 8.

Having thus described the invention, what is desired to be protected by Letters Patent is presented in the subsequently appended claims.

What is claimed is:

1. A foldable paper padding press for padding paper or other sheet material comprising:

a) a base plate assembly for providing a stationary platform, comprising a base bed plate;

b) a back plate assembly, wherein said back plate assembly is rotatably attached to said base plate assembly by a single axle shaft, wherein said back plate assembly is positioned perpendicular to said base plate assembly for loading said paper or other sheet material, wherein said back plate assembly rotates backwards around said base plate assembly for adhesive coating of said paper edges and forward around said base plate assembly for storage;

c) a clamp arm assembly, wherein said clamp arm assembly is attached to said single axle shaft, wherein said clamp arm assembly rotates forward and backward around said base plate assembly and said back plate assembly; and d) a means for compressing said paper or other sheet material in conjunction with said clamp arm assembly.

2. The foldable paper padding press as recited in claim 1, wherein in conjunction with said clamp arm assembly for compressing said paper or other sheet material, said means comprises at lease one said clamp arm with longitudinal slot, and at least one of the following: pressure plate, pressure bar, pressure wedge.

3. The foldable paper padding press as recited in claim 1, wherein in conjunction with said clamp arm assembly for compressing said paper or other sheet material, said means comprises at least one rod clamp arm, and at least one of the following: pressure plate, grip clamp, screw clamp.

* * * * *